United States Patent [19]

Sahar

[11] 4,233,774

[45] Nov. 18, 1980

[54] SPINNING TOP

[76] Inventor: Raphael Sahar, 2 King David St., Tiberias, Israel

[21] Appl. No.: 52,111

[22] Filed: Jun. 26, 1979

Related U.S. Application Data

[63] Continuation-in-part of Ser. No. 911,177, May 31, 1978, Pat. No. 4,202,133.

[51] Int. Cl.[3] ..... A63H 27/00

[52] U.S. Cl. ..... 46/82; 46/67; 273/417

[58] Field of Search ..... 46/64, 65, 60, 82, 83, 46/84, 85, 75, 47, 59, 67, 71; 273/317, 340, 417

[56] References Cited

U.S. PATENT DOCUMENTS

| | | | |
|---|---|---|---|
| 1,110,738 | 9/1914 | Berecz | 46/71 |
| 1,292,793 | 1/1919 | Joffe | 46/82 X |
| 1,462,221 | 7/1923 | Wolfe | 46/84 |
| 2,435,445 | 2/1948 | Kerezi | 46/60 |
| 2,799,120 | 7/1957 | Pitton | 46/83 X |
| 4,112,613 | 9/1978 | Toplak | 46/83 |

*Primary Examiner*—Robert Peshock
*Assistant Examiner*—Mickey Yu
*Attorney, Agent, or Firm*—Browdy and Neimark

[57] ABSTRACT

A spinning top comprises a casing in which is located a gear including a vertical shaft extending downwardly from the casing, the uppermost portion of the said shaft being a Z-profiled bar, the sidewardly extending arms of which are frictional contact with the ends of oppositely disposed horizontal axles turning in seats provided in the inner wall of the casing. On each of the said horizontal axles a crown wheel is keyed, both crown wheels being in mesh with a pinion, the central axle of which passes through the uppermost part of the spinning top. The said central axle of the pinion is functionally connected with the latter by a ratchet mechanism so that the rotational movement of the pinion is transmitted to the said axle in one direction only. To the outer, free end of the axle is keyed a propeller.

3 Claims, 2 Drawing Figures

SPINNING TOP

The present application is a continuation-in-part of my co-pending application Ser. No 911,177, filed May 31, 1978, now U.S. Pat. No. 4,202,133 May 13, 1979.

BACKGROUND OF INVENTION

Spinning tops are well known playthings and are well liked by children (and adults) as devices for outdoor playing. The conventional spinning tops are put into rotation by means of auxiliary devices, such as e.g. a pull-rope which is wound onto part of the top and which—when forcibly pulled imparts rotational movement to the top. In other tops the desired rotation is imparted to the spinning top by means of a spring which is tensioned and which on release sets the top into rotational, spinning movement.

OBJECT OF INVENTION

It is the object of the present invention to provide a spinning top which need not be put into rotation manually by the conventional means referred to above, but which spins automatically on hitting the ground (or any other surface) when dropped from above.

SHORT DESCRIPTION OF DRAWINGS

DETAILED DESCRIPTION OF PREFERRED EMBODIMENT

Figure 1:
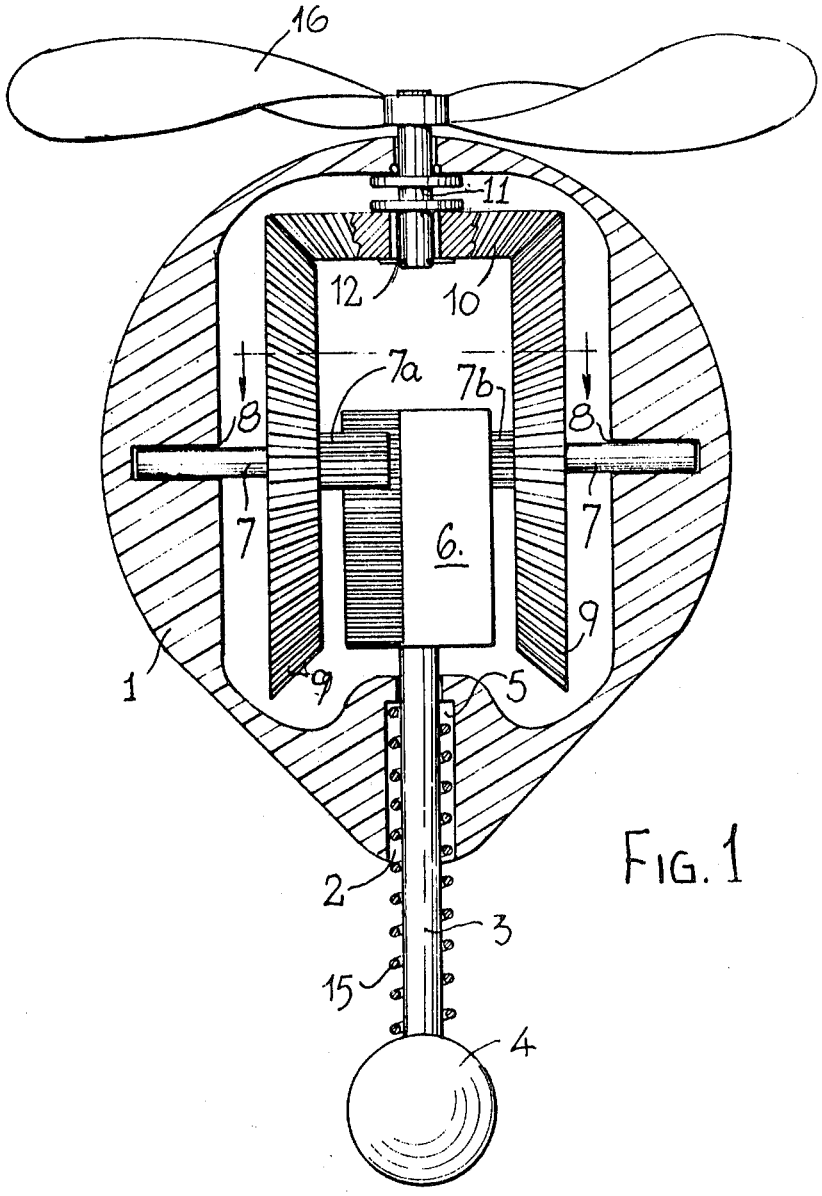
FIG. 1 is an elevational sectional view of the new spinning top.

The new spinning top comprises a pear shaped body or casing indicated by the numeral 1. The downwardly directed point of the pear shaped body has a central bore 2 out of which extends a vertical shaft 3 at the outer end of which is fixed an elastic sphere 4. At the top of bore 2 is formed an annular—downwardly directed—shoulder 5. A spring 15 extends between shoulder 5 and sphere 4 abutting against both these. To the top (within the body 1) of the shaft 3 is affixed a Z-profiled bar indicated as a whole by the figure 6. The sidewardly extending portions of the bar 6, indicated by *6a* and *6b* are in frictional contact with stubs *7a* and *7b* respectively which stubs are extensions of two horizontal axles 7 which are seated in recesses 8 provided in the inner wall of the body 1. The two axles 7 are co-directionally positioned. On each of the axles 7 is keyed a crown wheel 9, both meshing with a pinion 10. From pinion 10 and fixedly connected therewith extends a rod 11 which passes through the uppermost wall of the body 1. The connection between the pinion 10 and the rod 11 is by means of ratchet mechanisms 12. To the dipper end of rod 11 is keyed a propeller 16.

Figure 2:
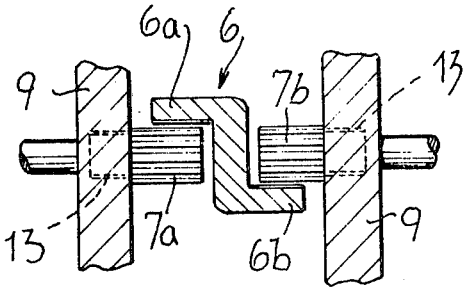
FIG. 2 is a fractional view on line II—II of FIG. 1.

As indicated in FIG. 2 of the drawing, the stubs *7a* and *7b* are connected with wheels 9 by ratchet mechanisms 13 permitting rotational movement of the two crown wheels in one direction only— i.e. to be imparted movement by shaft 3 moving inwardly, while the outward movement of the shaft 3, under urge of spring 15 does not affect the two crown wheels 9.

DESCRIPTION OF OPERATION

The new top is used in the following way:

It is thrown up in the air and is hit by a racquet at the sphere 4. Due to this, the shaft 3 is pushed inwardly the body 1 with the arm *6a* and *6b*—in frictional contact with stubs *7a* and *7b* respectively, rotating the latter. As a consequence both wheels 9 are rotated, which in turn rotate the pinion 10. This latter, being connected with rod 11 by ratchet 12, is rotated and the propeller is spun. This causes the top to hover and return slowly to the player who can now hit the sphere 4 again. The outward movement of shaft 3, under urge of the spring 15 does not cause rotational movement of the propeller.

I claim:

1. A spinning top comprising a hollow body having an inwardly extending bore in which slides a shaft the innermost end of which carries co-directional with the shaft a Z-profiled member, the sidewardly extending portions of the said Z-profiled member being in frictional contact with two oppositely disposed, co-directional axles seated rotationally in the wall of the said hollow body, a crown wheel being fixedly keyed on each of the said axles, both said crown wheels meshing with a pinion, an axle extending from the pinion and being connected therewith for transmission of rotational movement in one direction only, a propeller being fixed to the outer end of the said axle.

2. The spinning top claimed in claim 1 characterised thereby that the outer end of the said shaft carries an elastic sphere.

3. The spinning top claimed in claim 1 characterised thereby that the said shaft is surrounded by a spring urging the shaft outwardly of the hollow body.

* * * * *